United States Patent [19]

Mizoguchi

[11] Patent Number: 4,708,826

[45] Date of Patent: Nov. 24, 1987

[54] SUPERSONIC HUMIDIFIER

[75] Inventor: Saburo Mizoguchi, Osaka, Japan

[73] Assignee: Sharp Kabushiki Kaisha, Osaka, Japan

[21] Appl. No.: 708,714

[22] Filed: Mar. 6, 1985

[51] Int. Cl.[4] ..... B01F 3/04

[52] U.S. Cl. ..... 261/30; 239/102.1; 239/338; 261/81; 261/DIG. 48; 366/113

[58] Field of Search ..... 261/1, 30, 81, DIG. 15, 261/DIG. 48, DIG. 17; 366/111, 113–115; 239/102, 338, 102.1, 102.2; 128/200.16

[56] References Cited

U.S. PATENT DOCUMENTS

| | | | |
|---|---|---|---|
| 3,332,672 | 7/1967 | Schipper | 261/DIG. 15 |
| 3,456,927 | 7/1969 | Martin et al. | 261/30 X |
| 3,572,657 | 3/1971 | Bradley, Jr. | 261/30 |
| 3,575,387 | 4/1971 | Bradley, Jr. et al. | 261/30 |
| 3,637,195 | 1/1972 | Blazer et al. | 261/30 |
| 4,031,171 | 6/1977 | Asao et al. | 261/30 X |
| 4,087,495 | 5/1978 | Umehara | 261/81 |
| 4,238,425 | 12/1980 | Matsuoka et al. | 261/81 |

FOREIGN PATENT DOCUMENTS

| | | | |
|---|---|---|---|
| 127215 | 10/1980 | Japan | 261/81 |
| 129026 | 8/1984 | Japan | 261/81 |

*Primary Examiner*—Richard L. Chiesa

*Attorney, Agent, or Firm*—Flehr, Hohbach, Test, Albritton & Herbert

[57] ABSTRACT

A supersonic humidifier with a reduced number of components has a centrifugal ventilator fan contained in a casing which is not separately constructed but unistructurally formed on the lower surface of the housing. The fan is connected to a motor through a board having an air intake opening and the bottom surface of the casing is open. The bottom cover of the housing is designed to sealingly close the bottom surface of the casing.

4 Claims, 3 Drawing Figures

SUPERSONIC HUMIDIFIER

BACKGROUND OF THE INVENTION

This invention relates to an improved supersonic humidifier adapted to atomize water particles with supersonic waves and to disperse them into air and in particular to an improved ventilating system for such a humidifier.

FIG. 1 shows the structure of supersonic humidifiers which have been developed by the present inventor prior to this invention. An atomizing chamber 2 is disposed inside a housing 1 which also contains a water tank 3 below the atomizing chamber 2. A supersonic vibrator 4 is disposed at the bottom of the water tank 3 and is held by a heat radiating plate 5. An atomizing cylinder 6 is disposed inside the atomizing chamber 2 opposite the vibrator 4. A nozzle cylinder 7 is removably and rotatably disposed on the housing 1 so as to be in communication with the atomizing chamber 2. There are also shown a storage tank 8 from which water is supplied into the water tank 3, a ventilating cylinder 9 protruding into the atomizing chamber 2, a high frequency circuit 10 for driving the supersonic vibrator 4, a transformer 11, a centrifugal ventilator fan 12 inside a casing 13 and a bottom cover 14.

Mist generated by the supersonic vibrator 4 is blown by the wind from the ventilator fan 12 through the ventilating cylinder 9 and moves from the atomizing chamber 2 into the nozzle cylinder 7, passing through the atomizing cylinder 6. The mist is dispersed into the air through the cylinder 7, humidifying the atmosphere.

Humidifiers of this conventional design are disadvantageous because a separately constructed casing is necessary for the centrifugal fan in order to determine the directions of air intake and ventilation. This increases the number of components and hence that of assembly processes.

SUMMARY OF THE INVENTION

It is therefore an object of this invention to provide a humidifier of which the casing for its ventilator fan is formed by the housing and its back cover so that it need not be constructed separately and the number of components as well as the number of processes for assembly will be reduced.

The above and other objects of the present invention are achieved by providing a humidifier which is characterized in that a casing for the fan having one side wall, a top wall, a back wall and a ventilating opening but being open on the other side and to the bottom is unistructurally formed on the bottom surface of the humidifier housing, a centrifugal ventilator fan being contained in this casing and attached to a motor from the open side wall through a plate having an air intake opening. The bottom surface is designed to be sealed by a bottom cover of the housing.

BRIEF DESCRIPTION OF THE DRAWINGS

FIGS. 2 and 3 show a supersonic humidifier of the present invention wherein components identical to those in FIG. 1 are referenced by same numerals and explanation thereof is omitted.

DETAILED DESCRIPTION OF THE INVENTION

Figure 1:
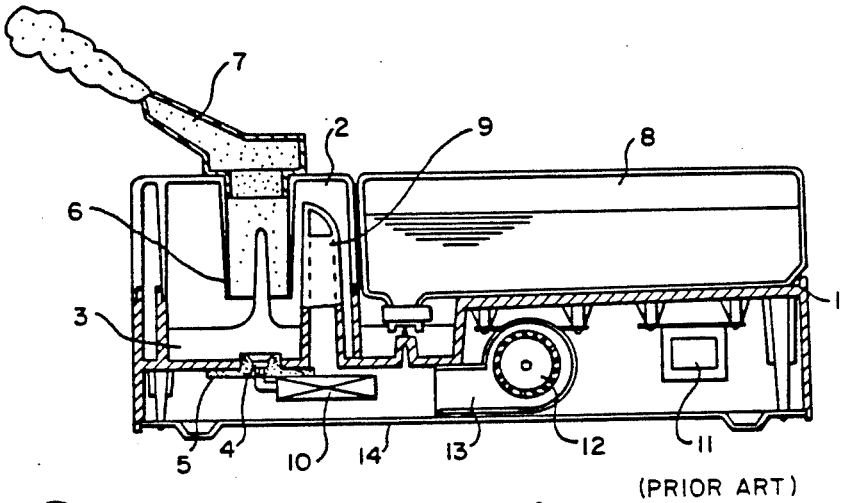
(PRIOR ART) FIG.—1
FIG. 1 is a cross-sectional view of a supersonic humidifier according to a conventional design.
Figure 2:
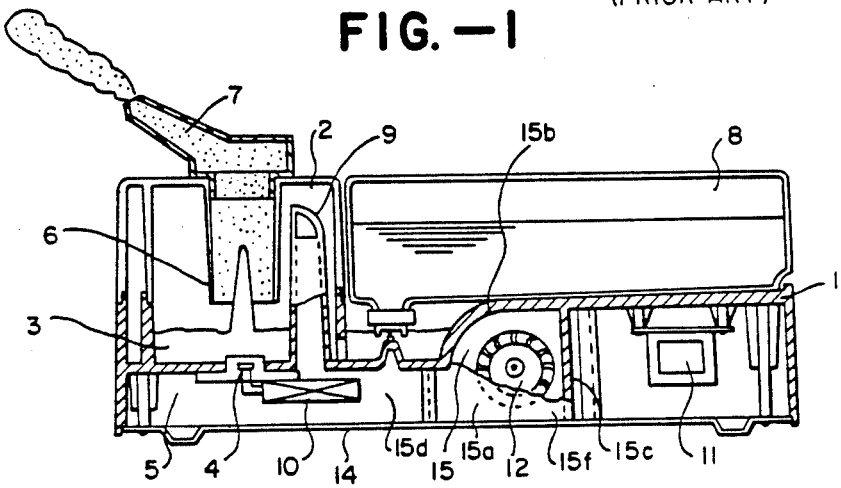
FIG. 2 is a cross-sectional view of a supersonic humidifier according to the present invention.
Figure 3:
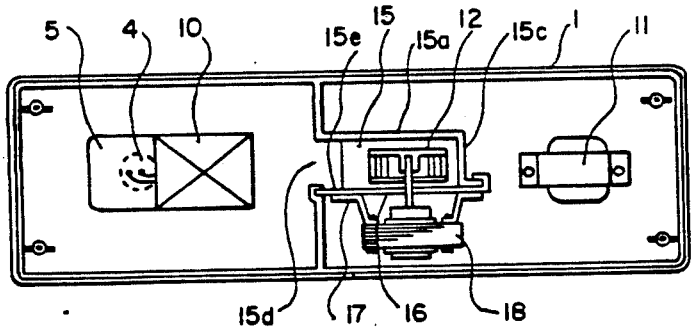
FIG. 3 is a bottom view of the supersonic humidifier of FIG. 2 when its bottom cover is removed.

There is on the bottom surface of the housing 1 a unistructurally formed casing means 15 for the centrifugal ventilator fan 12, having a side wall 15*a* on one side, a top wall 15*b*, a back wall 15*c* and a ventilating opening 15*d* in the frontal direction. The other side wall 15*e* on the opposite side and the bottom surface section 15*f* are open. The fan 12 is attached to a motor 18 through a board 17 having an air intake opening 16 and is contained inside the casing means 15. The bottom cover 14 for the housing 1 is adapted to sealingly close the bottom surface of the housing 1 and the bottom surface section 15*f* of the casing means 15.

In other words, the enclosure for the fan 12 is the casing means 15 which is unistructurally formed between the housing 1 and the bottom cover 14. Air which is taken in through the air intake opening 16 by the rotary motion of the fan 12 is passed through the ventilating opening 15*d* and is led into the atomizing chamber 2 through the ventilating cylinder 9. Mist generated by the supersonic vibrator 4 is dispersed through the atomizing cylinder 6 and the nozzle cylinder 7.

In summary, the present invention obviates the need to separately provide a casing for the centrifugal ventilator fan. Instead, the casing for the fan is unistructurally formed with the existing component. This not only reduces the total number of constituent components but also makes the assembly work much easier and reduces the production cost. Moreover, since the bottom cover of the housing is used to seal the bottom surface section of the casing means, it is only necessary to remove the bottom cover for repair or inspection and not only the interior of the housing but the ventilator fan and its motor can also be checked at the same time. This naturally has the effect of improving efficiency in repairs and inspections.

This invention has been described above in terms of only one embodiment. It should be understood, however, that various changes and modifications can be made within the spirit of this invention. The scope of this invention is limited only by the following claims.

What is claimed is:

1. In a supersonic humidifier comprising a housing having a bottom surface, a motor having a shaft disposed below said bottom surface, a centrifugal ventilator fan mounted on said shaft, and a bottom cover for said housing adapted to sealingly cover said bottom surface, the improvement wherein said humidifier further comprises a casing which encloses said fan, said casing having a side wall, a back wall and a top wall which are unistructurally formed on said bottom surface, and a holder for supporting said motor, said holder having an air intake opening and being disposed between said fan and said motor.

2. The humidifier of claim 1 wherein said shaft is oriented horizontally.

3. The humidifier of claim 1 wherein said casing is open in the direction opposite to said back wall.

4. The humidifier of claim 1 wherein said casing is open in a downward direction.

* * * * *